US009365958B2

(12) United States Patent
Yenici et al.

(10) Patent No.: US 9,365,958 B2
(45) Date of Patent: Jun. 14, 2016

(54) WOVEN STRETCH FABRIC AND METHOD FOR ITS PRODUCTION

(71) Applicant: Sanko Tekstil Islemeleri San. Ve Tic. A.S., Inegol, Bursa (TR)

(72) Inventors: Hamit Yenici, Inegol (TR); Fatma Korkmaz, Inegol (TR); Serdar Erdogan, Inegol (TR); Asli Can, Inegol (TR)

(73) Assignee: Sanko Tekstil Islemeleri San. Ve Tic. A.S., Inegol-Bursa (TR)

( * ) Notice: Subject to any disclaimer, the term of this patent is extended or adjusted under 35 U.S.C. 154(b) by 0 days.

(21) Appl. No.: 14/446,515

(22) Filed: Jul. 30, 2014

(65) Prior Publication Data

US 2015/0034205 A1 Feb. 5, 2015

(30) Foreign Application Priority Data

Jul. 31, 2013 (EP) ..... 13178831
Nov. 26, 2013 (EP) ..... 13194518

(51) Int. Cl.

| | |
|---|---|
| ***D03D 15/08*** | (2006.01) |
| ***D03D 13/00*** | (2006.01) |
| ***D03D 1/00*** | (2006.01) |
| ***D03D 23/00*** | (2006.01) |
| ***D03D 15/04*** | (2006.01) |
| *D03D 25/00* | (2006.01) |

(52) U.S. Cl.

CPC ..... *D03D 15/08* (2013.01); *D03D 1/00* (2013.01); *D03D 13/004* (2013.01); *D03D 15/04* (2013.01); *D03D 23/00* (2013.01); *D10B 2501/00* (2013.01)

(58) Field of Classification Search

CPC ..... D03D 15/08; D03D 15/00; D03D 1/00; D03D 2700/0103; D03D 13/004; D03D 13/008; D03D 15/04; D03D 13/00; D03D 7/00; D03D 17/00; D03D 25/00; D03D 2700/0133; D03D 2700/0137; Y10T 442/3024; Y10T 442/413; Y10T 442/3008; Y10T 442/3976; D10B 2401/061

See application file for complete search history.

(56) References Cited

U.S. PATENT DOCUMENTS

| | | | | |
|---|---|---|---|---|
| 4,563,384 | A * | 1/1986 | Wiehe et al. | 442/153 |
| 5,330,538 | A * | 7/1994 | Teague et al. | 8/114.6 |
| 5,858,885 | A * | 1/1999 | Hamilton et al. | 442/184 |
| 7,299,828 | B2 * | 11/2007 | Liao | 139/421 |
| 7,762,287 | B2 * | 7/2010 | Liao | 139/422 |
| 8,523,957 | B2 * | 9/2013 | Arioglu et al. | 8/502 |
| 8,615,979 | B2 * | 12/2013 | Yenici et al. | 57/236 |

(Continued)

OTHER PUBLICATIONS

International Search Report and Written Opinion dated Sep. 16, 2014, from the International Searching Authority in counterpart International Application No. PCT/EP2014/066384.

(Continued)

*Primary Examiner* — Bobby Muromoto, Jr.
(74) *Attorney, Agent, or Firm* — Sughrue Mion, PLLC

(57) ABSTRACT

A woven fabric has weft and warp yarns, the weft yarns are extending over and below the warp yarns to provide correspondent over portions and under portions with respect to the warp yarns, whereby the ratio length of under portions:length of over portions is such that in the washed fabric the warp yarns corresponding to the over portions are in a position that is lower than the plane of the warp yarns corresponding to the under portions; the final fabric, after washing, has an elongation measured according to ASTM 3107, of at least 30%.

48 Claims, 4 Drawing Sheets

(56) References Cited

U.S. PATENT DOCUMENTS

| | | | | |
|---|---|---|---|---|
| 2003/0066571 | A1* | 4/2003 | Ono et al. | 139/421 |
| 2007/0033748 | A1* | 2/2007 | Arioglu et al. | 8/636 |
| 2009/0191777 | A1 | 7/2009 | Liao | |
| 2011/0212659 | A1* | 9/2011 | Yenici et al. | 442/184 |
| 2012/0079802 | A1* | 4/2012 | Yenici et al. | 57/211 |
| 2013/0048140 | A1* | 2/2013 | Yenici et al. | 139/422 |
| 2013/0260129 | A1* | 10/2013 | Agzikara et al. | 428/221 |
| 2015/0034205 | A1* | 2/2015 | Yenici et al. | 139/421 |
| 2015/0038042 | A1* | 2/2015 | Erkus et al. | 442/203 |
| 2015/0133017 | A1* | 5/2015 | Liao et al. | 442/184 |

OTHER PUBLICATIONS

European Search Report for EP 13 19 4518 dated Jan. 16, 2014.

* cited by examiner

WOVEN STRETCH FABRIC AND METHOD FOR ITS PRODUCTION

The present invention relates to a woven stretch fabric and to a method for the production of said fabric. In particular, the present invention relates to a woven fabric used to produce clothing articles. A preferred type of fabric of the invention is denim; to denim is made reference in the following description, but the invention is not limited to the production of denim fabrics only.

BACKGROUND OF THE INVENTION

Knit fabrics is one of the oldest and maybe the easiest way of producing a fabric. In a knit fabric the yarns are making loops around each other and this bending results in softer fabrics that have greater volume than standard woven fabrics; knitted fabrics are much softer and more flexible than most of woven fabrics. However the fabric stability (i.e. the keeping of the original shape or "shape retention") is not as good as in woven fabrics. Therefore knit fabrics are used in topswear like jumpers or sweatshirts or t-shirts or for bottoms in more sportive fields like sweatpants due to their softness and comfortness.

A woven fabric is obtained by crossing weft yarns and warp yarns, in a weaving pattern whereby the weft yarns are extending over and below a number (1 or more) of warp yarns to provide, with respect to the warp yarns, correspondent over portions and under portions. A woven fabric has a face side (or front side) and a back side and the weft yarn floats over one or more warp yarns in the front side of the fabric and subsequently under one or more warp yarns, in the back side of the fabric. Vice versa, a warp yarn can float over or under the weft yarn respectively on the face (or front) side or on the back side of the fabric.

Denim is a popular fabric that is produced by weaving weft and warp yarns in a twill design.

In general, the most common denim fabrics are 3/1, 2/1 weave fabrics, more rarely 1/1 and sateen fabrics. The mentioned number indicates how many connection points there are in the smallest repeat construction unit, or weaving scheme, of warp and weft yarns. Thus, 1/1 means that at each connection the warp yarn is changing its position, namely from upside of the weft (face side of the fabric) to the downside of the weft yarn (back side of the fabric).

A ratio 2/1 means "two up, one down", i.e. that the weft yarn is floating under two warp yarns and than changing the position from down to up; every 3 weft insertions the warp yarn position is changed once. Similarly, in 3/1 construction every 4 weft insertion there is 1 warp yarn position changing and, in 4/1 every 5 weft insertion the warp yarn changes its position once. When there is a high number of position without changing, i.e. the longer is the length of the weft portion floating under the warp yarns, the looser and softer are the woven fabrics. Within this meaning, 1/1 weave is a fabric stiffer than a 4/1 fabric, in the same condition of remaining parameters such as characteristics of the yarns etcetera.

The most common weaves for denim are 1/1, 2/1 and 3/1, with twill looks; higher numbers of consecutive floating warps, such as 5/1 or higher, do not impart to the fabric the required denim look, while a 4/1 ratio is generally a borderline case.

A well known problem with denim fabrics is that fabrics obtained from 100% cotton yarns may be quite stiff and rigid, so that there is a lack of comfort for the user. To solve this problem denim fabrics have been provided with elastic yarns, usually weft yarns, that reduce stiffness of the fabric and improve wearability of the clothing article, in particular jeans. These fabrics are called "stretch woven fabrics" or "stretch fabrics".

Stretch fabrics have been known and manufactured for many years. In these known fabrics, the elastic yarn provides the elasticity required for the fabric to stretch and to recover the stretched portion. Because the elastic yarn is part of the fabric, in particular it can be the weft yarn, it is required that it does not compromise the aspect and the look of the fabric. To this purpose, the elastic yarns often include a core made of an elastomer and a cover for the core that is made of inelastic fibers, generally cotton fibers, so as to mimic the appearance of a standard, non-elastic, 100% cotton yarn.

There are known several tentative solutions for the problem of providing an elastic yarn having a satisfactory aspect notwithstanding the inclusion of elastomeric core; some of them are satisfactory, such as the solution disclosed in PCT application PCT/EP2011/005723 in the name of the present applicant.

WO2011104022, in the name of the present applicant, discloses a woven fabric in which the weft yarns are made by first yarns and second yarns that are different and that are woven with different patterns. The first yarns are less elastic that the second yarns and are woven with very long under portions so that when the fabric shrinks because of the action of the second yarns, that are more elastic than the first yarns, the long under portions of the first yarns provide a plurality of loops on the back side of the fabric and of the clothing garment obtained from the fabric.

However, a problem with known stretch fabrics is that they look too flat with respect to non-elastic fabrics, i.e. they have a two-dimensional appearance.

SUMMARY OF THE INVENTION

An aim of the present invention is to solve the above mentioned problem and to provide a fabric, and a relative method for producing such fabric, that is a stretch fabric and that has an aspect more 3-dimensional and closer to the look of standard fabrics, not comprising non-elastic fibers. Another aim of the invention is to provide a fabric that has the look of a denim and that has the feel and touch of a knitted fabric. Namely, it is an aim of the invention that the invention's woven fabric and the deriving garments are provided with the advantages of a knit fabric and relevant garments such as active wear, i.e. track suit top and bottom, T-shirts and polos, jogging and gym garments. These and other aims are achieved by a woven fabric (1) having weft yarns (3) and warp yarns (2, 2FS,2BS), wherein said fabric has a front side (FS) and a back side (BS), and at least 50%, preferably at least 80%, of the weft yarns (3) are elastic, said weft and warp yarns being woven together in a weaving pattern whereby the weft yarns (3) are extending over a number of warp yarns (2BS) and below a number of warp yarns (2FS) to provide weft over portions (5) in said front side and weft under portions (4, 4') in said back side (BS), characterized in that the warp yarns (2BS) corresponding to said over portions (5) of the weft yarn are biased by said elastic weft yarn (3) in a position that is lower than the plane of the warp yarns (2FS) corresponding to the under portions (4, 4') of the weft yarn (3), and wherein the fabric has an elongation measured according to ASTM 3107, of at least 30%.

A process of preparing a fabric can be achieved by weaving warp yarns and weft yarns, following a pattern whereby the weft yarns (3) are extending over a number of warp yarns (2BS) and below a number of warp yarns (2FS) to provide weft over portions (5) in said front side and weft under portions (4, 4') in said back side (BS), characterized in that at least 50%, preferably at least 80%, more preferably at least 90% of the weft yarns are elastic, removing said fabric from a weaving loom whereby the elastic warp yarns shrink and the warp yarns (2BS) corresponding to said over portions (5) of the weft yarn are biased by said elastic weft yarn (3) in a position that is lower than the plane of the warp yarns (2FS) corresponding to the under portions (4, 4') of the weft yarn (3), and wherein said fabric, after washing, has an elongation measured according to ASTM 3107, of at least 30%, preferably at least 40%, more preferably at least 50%.

In the following description reference is made to the "final fabric", with this wording it is defined the fabric that has been removed from the weaving loom and subjected to at least the finishing step of washing, preferably to the steps of heat-setting and washing. According to the invention, in the final fabric the warp yarns corresponding to said over portions of weft yarn, i.e. the warp yarns that float under the weft yarns are biased by said elastic weft yarns in a position that is lower than the plane of the warp yarns corresponding to the under portions, and wherein the final fabric, after washing, has an elongation measured according to ASTM 3107, of at least 30%, preferably at least 40%, more preferably at least 50%.

In a first condition the fabric is on the weaving loom and it is weaved in a standard way whereby the warp yarns are lying substantially on a same plane. According to the invention, at least 50% of the total of weft yarns are elastic yarns suitable to provide a stretch effect to the final fabric; preferably, the amount of elastic yarns over total weft yarns is at least 60%, preferably at least 70%, more preferably at least 85% and most preferably at least 95% of the total number of the weft yarns are elastic yarns. In a preferred embodiment all the weft yarns are elastic yarns. Preferably, all the elastic weft yarns have a same shrinkage ratio.

The amount and the type of elastic weft yarns over the total amount of weft yarns is such that the final fabric, after heat-setting (if any) and after washing, has an elongation measured according to ASTM 3107, of at least 30%, preferably at least 40%, more preferably at least 50%.

Because of the elasticity of the weft yarns, after removing the fabric from the loom, the weft yarns will retract, i.e. shrink, and return to a condition that is less stretched or substantially unstretched; in this step the warp yarns are brought closer together and the warp yarns that are below the weft yarns, i.e. in the back face of the fabric, are biased further away from the warp yarns in the front face of the fabric.

In the present description, under portions refer to portions being formed when weft yarns pass under a number of warp yarns, at the back side of the fabric, and said over portions refer to portions of weft yarn that are formed when the weft yarns pass along the front side of the fabric and define connection portions. The length of an under portion is measured by referring to the numbers of warp yarns that is passed by the weft between two changes: e.g. in FIG. 1 there are two under portions, one is long 2 and the other is long 5. In this particular weave, warp yarn passing, i.e. the length of an under portion, is long on one part of the weave and on the other part, passing is shorter, in order to hold together the fabric like regular wovens. Passing long gives the softness and passing shorter gives the woven fabrics advantages like shape retention. Most preferably, all the weft yarns have the same weave pattern, contrary to the above cited prior art.

In greater detail, in the weaving weft pattern of a weave unit (or repeating unit) such as those shown in the figures, the ratio of total weft amount of under portions with respect to full weft pattern length should preferably be minimum 5/11 (45%), more preferably minimum 6/11, and maximum 9/11 (82%); similarly, in a weaving warp pattern the total warp amount of over portions/full warp pattern length should preferably be min 5/11 and max 9/11. In a repeating unit of 9×9 the minimum amount of under portions (i.e. number of warps that are passed under) is 4/9 (44%); in a repeating unit 8×8 the maximum can be 6/8 (75%). If expressed in percentage, the amount of under portions, i.e. of warp yarns under which the weft yarn passes, over the total amount of warp yarns is in the range of about 42% to 85% in a repeat unit. At the same time, in a weaving warp and weft pattern length, there should be min 2 times an under portion, 2 times an over portion, i.e. in a repeating unit the minimum amount of under portions and over portions, independently of their length, is always 2.

As above mentioned, the elastic weft yarns form alternately arranged under portions and over portions with respect to the warp yarns in a weave that provides an alternation of one under portion with one over portion of the weft. In an exemplary embodiment, there is provided an alternation of at least one long under portion and one short under portions with two short over portions so as to have a scheme with long under/short over/short under/short over. In other exemplary embodiments there may be provided both long under portions and long over portions. As previously mentioned and as disclosed in the figures, according to the preferred embodiments of the invention, the scheme or weaving pattern of the weft yarns is identical for all the weft yarns of the fa; in other words, in each repeat unit, every weft yarn has the same amount of over portions and under portions and the same length of the said portions. This applies to elastic weft yarns and non-elastic weft yarns, in the case that some non-elastic weft yarns are present.

A long portion (either under or over) is a portion with a passing of at least three warp yarns, i.e. a portion where the weft floats under or over at least three warps, preferably four or five warps. A short portion (either under portion or over portion) is a portion with a passing of one or two warp yarns, i.e. a portion where the weft floats under or over one or two warps, preferably two warp yarns.

According to a preferred embodiment, the weaving pattern of the weft is selected from any of 5/2/2/2; 5/1/1/1/4/1/1/3; 5/1/1/1/3/4; 4/2/1/1; 5/2/2/1; 4/1/2/2; 5/1/1/1; 4/2/2/1. Preferred schemes for the warp pattern are selected from: 5/1/1/2/1/1; 8/3/1/2/2/1; 7/2/1/3/1/1; 4/2/1/1; 6/1/1/2; 5/1/1/2; 5/1/1/1. Preferred combinations are disclosed in FIGS. 3-10.

According to another embodiment of the invention, the elastic weft yarns have a count in the range of 70 to 300 denier, preferably 100 to 250 denier. In a preferred embodiment, the warp yarns are cotton yarns, the count for the warp yarns being in the range of 16 to 40 Ne, preferably 20 to 30, more preferably 24 to 30.

The fabric according to the invention has several advantages over the prior art stretch fabrics.

The result of the weaving technique is a fabric were a known weaving pattern is modified by using a new warp and weft combination providing:

- a fabric that has a high elastic weft stretch condition,
- a fabric weave that, from the construction point of view, is not a twill, and that after having been removed from the loom and after consequent shrink, has a twill look,
- a fabric that has at the same time softness and firmness,
- a fabric that has a three-dimensional look, similar to standard denim fabric
- a fabric that has the feeling and the hand and texture of fabrics obtained by knitting;
- a fabric that is suitable to be used for active wear garments, namely sport garments such as tracksuits and in general loose fitting sport garments.

The invention is now disclosed with reference to FIGS. 1 to 10 that show non-limiting exemplary embodiments of the invention.

DETAILED DESCRIPTION OF THE INVENTION

Figure 1:
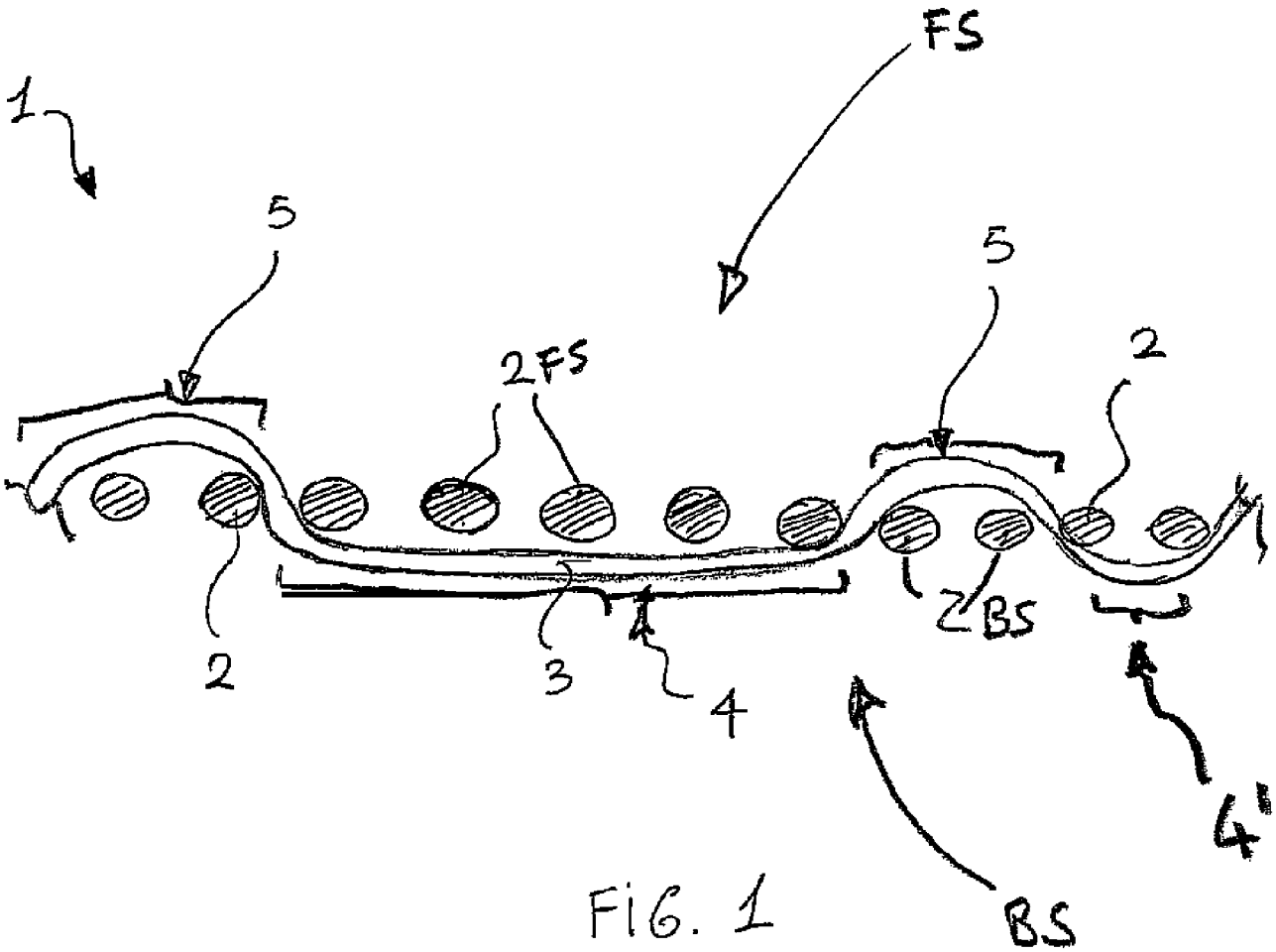
FIG. 1 is a section view of a possible embodiment of the fabric according to the invention on the weaving loom.

With reference to FIG. 1, it is shown a woven fabric according to the invention in a condition where the fabric is still on a weaving loom. The woven fabric 1 according to the invention comprises a plurality of warp yarns 2 and a plurality of weft yarns 3 woven together in a pattern forming a fabric having a front side FS (i.e. an outer face side) and a back side BS, the front side being the face of the fabric that is visible when a clothing item made of the fabric is worn by the user. If the fabric is a denim, the front side is the side having the greater amount of visible warp yarns, e.g. FS in FIG. 1 and FIG. 2. As mentioned, clothing items, i.e. garments, made with the invention fabric and having the mentioned front and back sides are an object of the present invention.

The fabric has a weaving pattern where the weft yarns 3 are extending, i.e. floating, over and below the warp yarns 2 to provide correspondent over portions 5 and under portions 4 with respect to the warp yarns. The under portions are formed when the weft yarns pass along the back side BS of the fabric and the over portions are formed when the weft yarns float over the warp yarns and pass along the front side FS of the fabric. Similarly, the warp yarns have over portions and under portions with respect to the weft yarns.

FIG. 1 schematically shows the fabric in a condition corresponding to the condition when the fabric is on a weaving loom. Warp yarns 2 have also been referred to as 2FS for those warps forming the face side of the fabric; reference 2BS indicates the warps forming the back side of the fabric.

Weaving pattern may have diagonal twill lines look, a twill look in the final fabric is a most preferred feature.

According to the invention at least 50%, or 60%, of the weft yarns 5 are elastic, preferably at least 80%, more preferably at least 90 or 95%, most preferably all the weft yarns are elastic. In any case, the final fabric, after washing, has an elongation measured according to ASTM 3107, of at least 30%, preferably at least 40%, more preferably at least 50%. The washing step is carried out according to ASTM D 3776/96 or according to BS 63302A. As previously mentioned, the weft yarns 3 have over portions 5 and under portions 4; with the wording "length of over portions" we mean the number of adjacent warp yarns 2BS that are passed over by a weft yarn 5 before the weft yarns goes under a warp yarn 2FS. According to the invention, warp yarn passing is longer on one part of the weave and on the other part, passing is shorter, the shorter portions being necessary in order to hold together the fabric like regular wovens. Passing long gives the fabric the required softness and passing shorter gives the woven fabrics advantages like shape retention.

Figure 2:
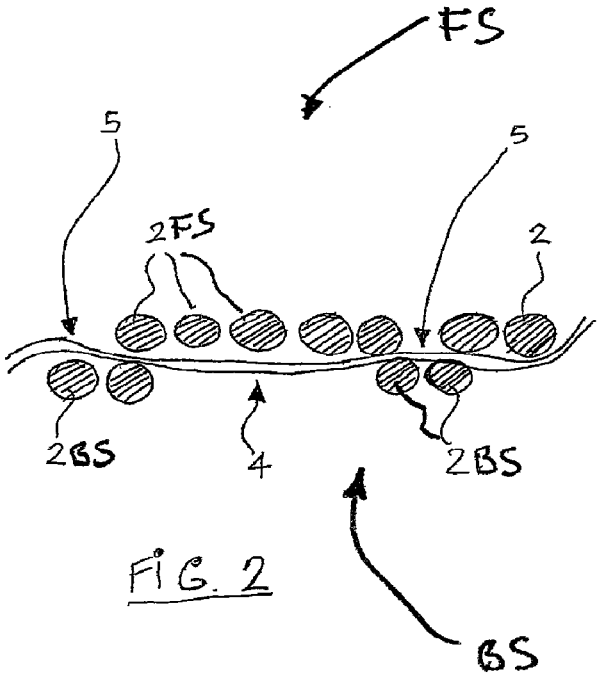
FIG. 2 is a section view of the fabric according to FIG. 1 after washing.
Figure 3:
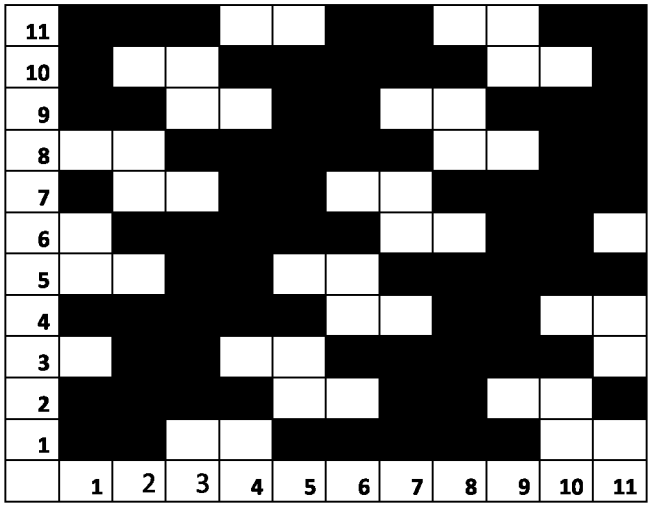
FIG. 3 is a weave report, or scheme, of the fabric shown in FIGS. 1 and 2.

Thus, the lengths of over portions 5 are shorter than those of the under portions 4, i.e. the over portions 5 pass less warp yarns 2BS than under portions 4, as visible in FIG. 1 and FIG. 2 and from the weaving report of FIG. 3. Similarly, the "length of under portions 4" is the number of adjacent warp yarns 3FS that are passed under by a weft yarn 5 before the weft yarns goes up again over a warp yarn. In FIG. 3 the ratio is 5:2.

In general, in a repeat unit the weaving weft pattern the ratio of total weft amount of under portions (measured as per above, by indicating the amount of warp yarns passed) with respect to full weft pattern length should be min 5/11 and max 9/11; similarly, in a weaving warp pattern the total warp amount of over portions/full warp pattern length, should be in the range of min 5/11 and max 9/11. At the same time there preferably should be minimum 2 times under portion and 2 times over portion, i.e. in a repeat unit, as shown in FIG. 1, there are two over portions 5 and two under portions 4 and 4'.

As visible in the exemplary embodiment of FIG. 1, the under portions of a same weft do not necessarily have all the same length; namely, in the shown embodiment, length of under portion 4 is five and that of under portion 4' is two.

Additionally, in a preferred aspect of the invention, the minimum amount of under portions and over portions is always 2, both for warps and wefts.

A preferred ratio of length of weft's under portions:length of weft's over portions is 5:2 i.e. five warps in an under portion per two warps in an over portion of the weft yarn; in general the ratio length of under portions:length of over portions is within the range 2:1 to 5:1. For the warp yarns the ratio length of under portions:length of over portions is preferably within the range 2:1 to 7:1.

In any case, according to the invention, the above discussed ratio is such that once the fabric is removed from the weaving loom the weft yarns, that are elastic, will retract, become shorter and "squeeze" the over portions 5 of the weft 3 downwards. The final aspect will be that of a three-dimensional fabric, preferably of a denim fabric.

The result is schematically shown in FIG. 2, showing that the warp yarns 2BS corresponding to over portions 5 of weft 3, have been brought into a plane lower than the plane of the remaining warp yarns 2FS, i.e. the plane of the warp yarns corresponding to the under portions 4 of the weft yarns. FIG. 1 shows the fabric on the weaving loom and FIG. 2 the fabric after washing and heat-setting (if this step is actually carried out).

Since weft yarns 5 are elastic, when the fabric shrinks, this particular short passing parts 5 of the weft 3 in the final fabric remain partially hidden between the long passing side.

Thanks to this effect and to the starting weaving pattern, the final fabric looks like a twill which has soft and flexible hand, like knit fabrics, but at the same time it is provided with shape retaining properties and sufficient firmness of the fabric. this result is reached thanks to the "hidden" short over portions 5 and thanks to the frequent changing of the position of weft yarns around warp yarns, as per the requested presence of at least two under portions and two over portions in a repeat unit.

FIG. 3 shows a weave report (a repeat unit) of a preferred embodiment of the fabric according to the invention. Sectional views of FIGS. 1 and 2 show the horizontal line 1 of the weave report of FIG. 3.

The preferred range for the ratio length of under portions: length of over portions for the warp yarns is 2:1 to 7:1. All ranges here mentioned are inclusive of their cited figures, e.g. in this case inclusive of both 2:1 and 7:1. The minimum amount of warp yarns passed by an over portion (i.e. the length of an over portion) is 1, with a preferred maximum of 4 passed yarns. Preferably the minimum amount of passed yarns for the under portions is 4 and the maximum is 8 passed yarns.

Preferred weaving reports have a weft from 8 to 18 yarns and a warp from 8 to 18 yarns; preferably the report is square, i.e. 8×8 to 18×18.

The warp yarns 2, 2FS, 2BS are preferably in cotton, preferably indigo dyed to provide a final denim fabric. The count for the warp yarns is in the range of 16 to 40 Ne, preferably 20 to 30, more preferably 24 to 30.

The elastic, i.e. stretch, weft yarns 3 are preferably provided with an elastomeric core and a inelastic layer of fibers as in the well known core spun or twisted yarns. The count of the weft yarns is preferably 18 to 50 Ne, preferably 20 to 30 for cotton staple and 40 to 300 denier, preferably 70 to 140 for the elastic core.

Any non elastic weft yarn that may be present, is preferably in the range of the warp yarns' count as above mentioned. As previously mentioned, preferably at least 8 weft yarns out of 10 are elastic yarns, more preferably at least 9 out of 10, most preferably 10 out of 10 weft yarns are elastic yarns. A fully synthetic elastic weft yarns has a count in the range of 70 to 300 denier, preferably 100 to 250 denier.

The above counts for weft and warp are hereby intended to be disclosed with an embodiment in which the following features are also present:

a fabric having at least 50%, preferably at least 80%, more preferably at least 90% of elastic weft yarns that provide an elongation of at least 30% by ASTM 3107 in the final (finished) fabric; wherein the repeat unit comprises at least two under portions, and at least two over portions at least for the weft pattern, preferably both for weft and warp patterns.

Preferably, the weaving pattern for the weft yarns is identical for all weft yarns.

Most preferably, the above features are present in a repeat unit having a total warp amount of over portions/full warp pattern length in the range of 5/11 to 9/11 (i.e. a range from a pattern where out of 11 warp yarns 5 are up and 6 are down to a pattern where 9 warps are up and 2 down).

Elastomeric fibers suitable for use in the present invention are known in the art and are either a continuous filament or a plurality of filaments which have a break elongation in excess of 100% of its original length. Exemplary elastomeric fibers include but are not limited to rubber filament, bi-component filament and elastoester, lastol, and spandex. The terms "elastomeric" and "elastic" are used interchangeably throughout the specification.

The elastomeric fiber is preferably covered by staple fibers, i.e. surrounded by, twisted with, core spun with or intermingled with cotton or other non-elastic fibers. After weaving, the fabric is thermally treated in a way known in the art so as to bring the final value of elongation, after washing, in the required range, i.e. at least 30% by ASTM 3107.

As shown in FIG. 2, after removal from loom, and also after washing, a fabric with the above features will have the warp yarns arranged on two different levels; the resulting stretch fabric has the appearance and the feeling of a thick, "standard" denim fabric while still being stretchable and very comfortable to wear.

FIG. 3 is the weaving report or weaving scheme of the embodiment shown in FIGS. 1 and 2. FIG. 3 scheme is an 11×11 construction provided with a weft passing having one long (length 5) and one short (length 2) under portions and two short (length 2 and 2) over portions. The scheme is 5/2/2/2 (left to right) for the weft and 5/1/1/2/1/1 for the warp (bottom to top). In FIG. 3 the ratio of weft under portions to total length is 7/11.

FIGS. 4 to 9 are schemes of further possible weaving embodiments according to the invention.

Figure 4:
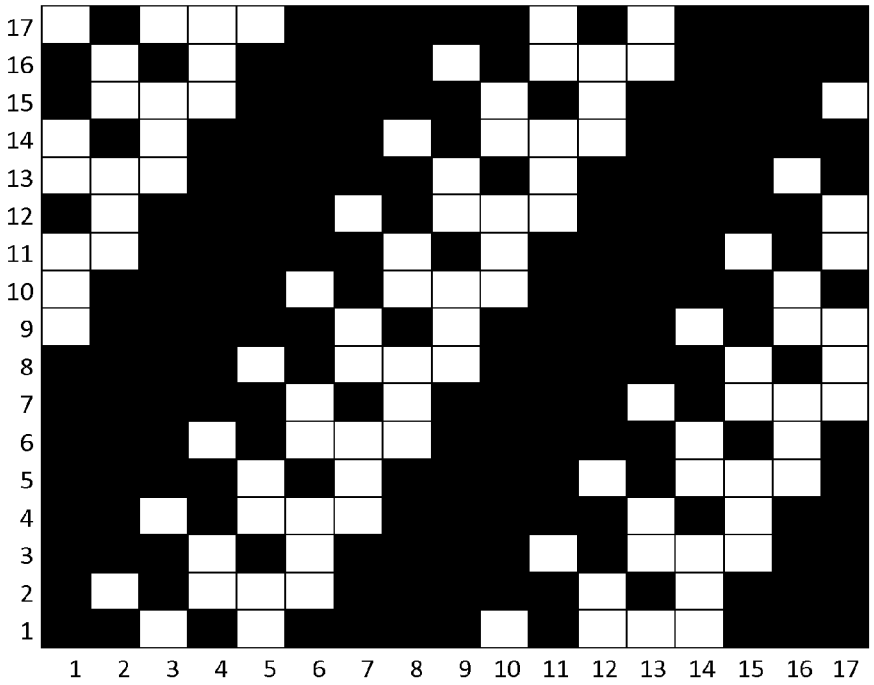
FIGS. 4 to 10 are weave reports of other embodiments of the inventions
Figure 5:
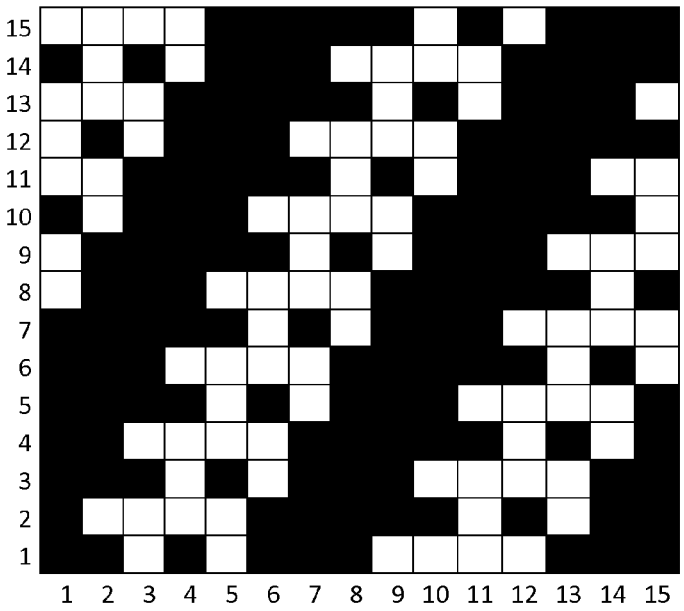

FIG. 4 scheme is provided with a weft passing having two long and two short under portions and one long and three short over portions with a scheme 5/1/1/1/4/1/1/3 (left to right). In FIG. 4 the ratio of weft under portions to total length is 11/17; the warp scheme is 8/3/1/2/2/1. Similarly, the pattern of FIG. 5 is provided with a weft passing having two long (passing length 5 and 3) and one short under portions and one long Passing is 4) and two short over portions with a scheme 5/1/1/1/3/4 (left to right). In FIG. 5 the ratio of weft under portions to total length is 9/15; the warp scheme is 7/2/1/3/1/1.

Figure 6:
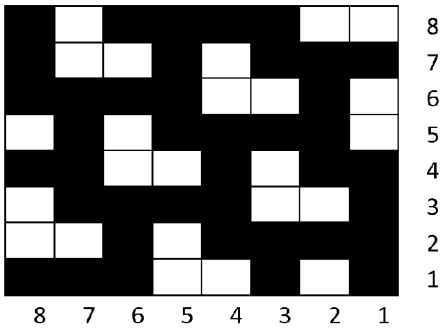

FIG. 6 scheme is an 8×8 construction provided with a weft passing having one long (length 4) and one short (length 1) under portions and two short (length 2 and 1) over portions with a scheme 4/2/1/1 (left to right). In FIG. 6 the ratio of weft under portions to total length is 5/8; the warp scheme is the same as for the weft, 4/2/1/1.

Figure 7:
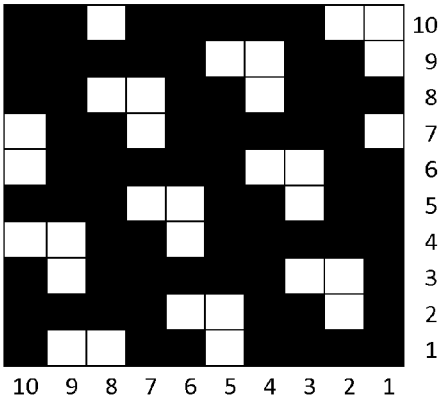
Figure 8:
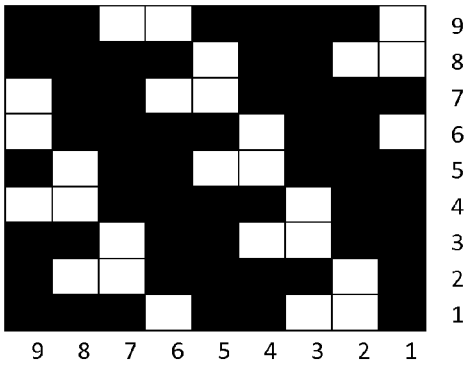
Figure 9:
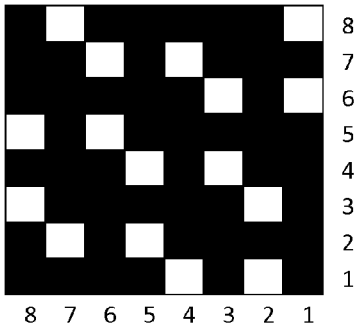
Figure 10:
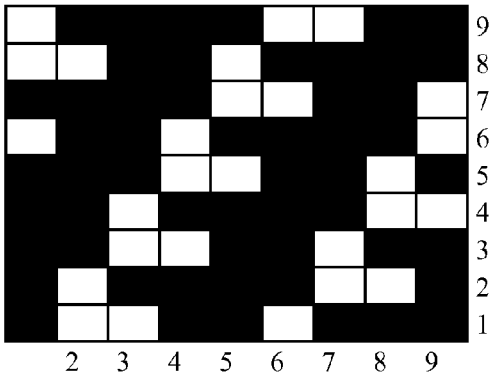

FIG. 7 scheme is a 10×10 construction provided with a weft passing having one long (length 5) and one short (length 2) under portions and two short (length 2 and 1) over portions with a scheme 5/2/2/1 (left to right). In FIG. 7 the ratio of weft under portions to total length is 7/10; the warp scheme is 6/1/1/2. FIG. 8 scheme is a 9×9 construction provided with a weft passing having one long (length 5) and one short (length 2) under portions and two short (length 2 and 1) over portions with a scheme 4/1/2/2 (left to right). In FIG. 8 the ratio of weft under portions to total length is 6/10; the warp scheme is 5/1/1/2. FIG. 9 scheme is an 8×8 construction provided with a weft passing having one long (length 5) and one short (length 1) under portions and two short (length 1 and 1) over portions with a scheme 5/1/1/1 (left to right). In FIG. 10 the ratio of weft under portions to total length is 6/8; the warp scheme is 5/1/1/1, same as for the weft.

FIG. 10 scheme is a 9×9 construction provided with a 4/2/2/1 scheme, i.e. a weft passing one long (length 4 warps) and one short (length 2) under portion and two short over portions (lengths 2 and 1). The ratio of weft under portions to total length is 6/9; the warp scheme is 5/1/1/2.

As it can be gathered from the above description, all the exemplary and preferred embodiment relate to a fabric having at least 50%, preferably at least 80%, more preferably at least 90% of elastic weft yarns that provide an elongation of at least 30% by ASTM 3107 in the final (finished) fabric; in a repeat unit having a total warp amount of over portions/full warp pattern length in the range of 5/11 to 9/11 (i.e. a range going from a pattern where out of 11 warp yarns 5 are up and 6 are down to a pattern where 9 warps are up and 2 down) and wherein the repeat unit comprises at least two under portions, and at least two over portions at least for the weft pattern, preferably both for weft and warp patterns.

Thanks to the presence of the above features, the fabrics obtained with the above construction scheme have a significant elasticity and a three-dimensional look that improves the texture and the look of the fabric of the invention with respect to previously known stretch fabrics.

The following table shows a comparison between an exemplary standard denim fabric and an exemplary "denim" fabric according to the present invention.

Table 1.

TABLE 1

| | regular denim | new construction |
|---|---|---|
| warp count | Ne 6/1-Ne 14/1 | Ne 20/1-Ne 50/1 |
| weft count | Ne 8/1-Ne 12/1 | Ne 18/1-Ne 30/1 |

TABLE 1-continued

| | 150 DEN-300 DEN | 70-300 DEN |
|---|---|---|
| picks | 15-22 picks per cm | 22-30 picks per cm |
| weave | 2/1, 3/1, 1/1, 4/1, sateen . . . | as shown |

The denim fabric according to the invention is a stretch denim having a three-dimensional look as is three-dimensional the look of the standard denim fabric.

The invention claimed is:

1. A woven fabric (1) having weft yarns (3) and warp yarns (2, 2FS,2BS), wherein said fabric has a front side (FS) and a back side (BS), and at least 50% of the weft yarns (3) are elastic, said weft and warp yarns being woven together in a weaving pattern whereby the weft yarns (3) are extending over a number of warp yarns (2BS) and below a number of warp yarns (2FS) to provide weft over portions (5) in said front side and weft under portions (4, 4') in said back side (BS), wherein the warp yarns (2BS) corresponding to said over portions (5) of the weft yarn are positioned, and biased by said elastic weft yarn (3), in a first plane which is lower than the under portions (4, 4') of the weft yarn (3) such that the warp yarns 2BS are positioned on the first plane which does not overlap with a second plane on which the warp yarns (2FS) are positioned on, and wherein the fabric has an elongation measured according to ASTM 3107, of at least 30%.

2. A woven fabric (1) having weft yarns (3) and war a yarns (2, 2FS,2BS), wherein said fabric has a front side (FS) and a back side (BS), and at least 50% of the weft yarns (3) are elastic, said weft and warp yarns being woven together in a weaving pattern whereby the weft yarns (3) are extending over a number of warp yarns (2BS) and below a number of warp yarns (2FS) to provide weft over portions (5) in said front side and weft under portions (4, 4') in said back side (BS), wherein the warp yarns (2BS) corresponding to said over portions (5) of the weft yarn are positioned, and biased by said elastic weft yarn (3), in a first plane which is lower than the under portions (4, 4') of the weft yarn (3), wherein the weave pattern of the weft yarns is identical for all the weft yarns of the said fabric and wherein the fabric has an elongation measured according to ASTM 3107, of at least 30%.

3. The fabric according to claim 1, wherein the weave pattern of the weft yarns is identical for all the weft yarns of the said fabric.

4. The fabric according to claim 1, wherein for the weft yarns the ratio of length of under portions:length of over portions is 2:1 to 5:1.

5. The fabric according to claim 1, wherein for the warp yarns the ratio length of under portions:length of over portions is within the range 2:1 to 7:1.

6. The fabric according to claim 1, wherein in a repeat unit a ratio of total weft length of under portions (4, 4') with respect to total weft length is within the range of 5/11 to 9/11.

7. The fabric according to claim 1, wherein a total warp amount of over portions with respect to total warp amount is in the range of 5/11 to 9/11.

8. The fabric according to claim 1, whereby said repeat unit comprises at least two under portions, and at least two over portions at least for the weft pattern.

9. The fabric according to claim 1, that is a denim fabric.

10. The fabric according to claim 1, wherein said weaving pattern of the weft is selected from any of 5/2/2/2; 5/1/1/1/4/1/1/3; 5/1/1/1/3/4; 4/2/1/1; 5/2/2/1; 4/1/2/2; 5/1/1/1; 4/2/2/1.

11. The fabric according to claim 1, wherein said weaving pattern of the warp is selected from any of 5/1/1/2/1/1; 8/3/1/2/2/1; 7/2/1/3/1/1; 4/2/1/1; 6/1/1/2; 5/1/1/2; 5/1/1/1.

12. The fabric according to claim 1, wherein said elastic weft yarns have a count in the range of 70 to 300 denier.

13. The fabric according to claim 1, wherein said warp yarns (2, 2FS, 2BS) are cotton yarns, the count for the warp yarns being in the range of 16 to 40 Ne.

14. A process of preparing a fabric, characterized by weaving warp yarns and weft yarns, following a pattern whereby the weft yarns (3) are extending over a number of warp yarns (2BS) and below a number of warp yarns (2FS) to provide weft over portions (5) in said front side and weft under portions (4, 4') in said back side (BS), characterized in that at least 50% of the weft yarns are elastic, removing said fabric from a weaving loom whereby the elastic warp yarns shrink and the warp yarns (2BS) corresponding to said over portions (5) of the weft yarn are biased by said elastic weft yarn (3) in a position that is lower than the plane of the warp yarns (2FS) corresponding to the under portions (4, 4') of the weft yarn (3), and wherein said fabric, after washing, has an elongation measured according to ASTM 3107, of at least 30%, wherein the warp yarns (2BS) corresponding to said over portions (5) of the weft yarn are are biased by said elastic weft yarn (3) to a first plane which is lower than the under portions (4, 4') of the weft yarn (3) such that the warp yarns 2BS are positioned on the first plane which does not overlap with a second plane on which the warp yarns (2FS) are positioned on.

15. The process according to claim 14, wherein the weave pattern of the weft yarns is identical for all the weft yarns of the said fabric.

16. A clothing article or garment comprising a fabric according to claim 1.

17. The clothing article according to claim 16, wherein the warp and/or the weft yarns of the fabric of said article are indigo dyed.

18. The clothing article according to claim 16, that is selected form sport garments, tracksuits, jogging garments, gym clothing including shorts, T-shirts, tops, jackets, sport bras and loose fitting sport garments.

19. The fabric according to claim 1, wherein at least 80% of the weft yarns (3) are elastic.

20. The fabric according to claim 1, wherein 100% of the weft yarns (3) are elastic.

21. The fabric according to claim 1, wherein the fabric has an elongation of at least 50% (by ASTM 3107).

22. The fabric according to claim 1, whereby said repeat unit comprises at least two under portions, and at least two over portions for the weft and warp pattern.

23. The fabric according to claim 1, wherein said elastic weft yarns have a count in the range of 100 to 250 denier.

24. The fabric according to claim 1, wherein said warp yarns (2, 2FS, 2BS) are cotton yarns, the count for the warp yarns being in the range of 20 to 30 Ne.

25. The fabric according to claim 1, wherein said warp yarns (2, 2FS, 2BS) are cotton yarns, the count for the warp yarns being in the range of 24 to 30.

26. A process of preparing a fabric according to claim 2, characterized by weaving warp yarns and weft yarns, following a pattern whereby the weft yarns (3) are extending over a number of warp yarns (2BS) and below a number of warp yarns (2FS) to provide weft over portions (5) in said front side and weft under portions (4, 4') in said back side (BS), characterized in that at least 50% of the weft yarns are elastic, removing said fabric from a weaving loom whereby the elastic warp yarns shrink and the warp yarns (2BS) corresponding to said over portions (5) of the weft yarn are biased by said elastic weft yarn (3) in a position that is lower than the plane of the warp yarns (2FS) corresponding to the under portions (4, 4') of the weft yarn (3), wherein the weave pattern of the weft yarns is identical for all the weft yarns of the said fabric, and wherein said fabric, after washing, has an elongation measured according to ASTM 3107, of at least 30%.

27. The fabric according to claim 2, wherein the weave pattern of the weft yarns is identical for all the weft yarns of the said fabric.

28. The fabric according to claim 2, wherein for the weft yarns the ratio of length of under portions:length of over portions is 2:1 to 5:1.

29. The fabric according to claim 2, wherein for the warp yarns the ratio length of under portions:length of over portions is within the range 2:1 to 7:1.

30. The fabric according to claim 2, wherein in a repeat unit a ratio of total weft length of under portions (4, 4') with respect to total weft length is within the range of 5/11 to 9/11.

31. The fabric according to claim 2, wherein a total warp amount of over portions with respect to total warp amount is in the range of 5/11 to 9/11.

32. The fabric according to claim 2, whereby said repeat unit comprises at least two under portions, and at least two over portions at least for the weft pattern.

33. The fabric according to claim 2, that is a denim fabric.

34. The fabric according to claim 2, wherein said weaving pattern of the weft is selected from any of 5/2/2/2; 5/1/1/1/4/1/1/3; 5/1/1/1/3/4; 4/2/1/1; 5/2/2/1; 4/1/2/2; 5/1/1/1; 4/2/2/1.

35. The fabric according to claim 2, wherein said weaving pattern of the warp is selected from any of 5/1/1/2/1/1; 8/3/1/2/2/1; 7/2/1/3/1/1; 4/2/1/1; 6/1/1/2; 5/1/1/2; 5/1/1/1.

36. The fabric according to claim 2, wherein said elastic weft yarns have a count in the range of 70 to 300 denier.

37. The fabric according to claim 2, wherein said warp yarns (2, 2FS, 2BS) are cotton yarns, the count for the warp yarns being in the range of 16 to 40 Ne.

38. A clothing article or garment comprising a fabric according to claim 2.

39. The clothing article according to claim 38, wherein the warp and/or the weft yarns of the fabric of said article are indigo dyed.

40. The clothing article according to claim 39, that is selected form sport garments, tracksuits, jogging garments, gym clothing including shorts, T-shirts, tops, jackets, sport bras and loose fitting sport garments.

41. The fabric according to claim 2, wherein 100% of the weft yarns (3) are elastic.

42. The fabric according to claim 2, wherein the fabric has an elongation of at least 50% (by ASTM 3107).

43. The fabric according to claim 2, whereby said repeat unit comprises at least two under portions, and at least two over portions for the weft and warp pattern.

44. The fabric according to claim 2, wherein said elastic weft yarns have a count in the range of 100 to 250 denier.

45. The fabric according to claim 2, wherein said warp yarns (2, 2FS, 2BS) are cotton yarns, the count for the warp yarns being in the range of 20 to 30 Ne.

46. The fabric according to claim 2, wherein said warp yarns (2, 2FS, 2BS) are cotton yarns, the count for the warp yarns being in the range of 24 to 30.

47. A process of preparing a fabric according to claim 2, characterized by weaving warp yarns and weft yarns, following a pattern whereby the weft yarns (3) are extending over a number of warp yarns (2BS) and below a number of warp yarns (2FS) to provide weft over portions (5) in said front side and weft under portions (4, 4') in said back side (BS), characterized in that at least 80% of the weft yarns are elastic, removing said fabric from a weaving loom whereby the elastic warp yarns shrink and the warp yarns (2BS) corresponding to said over portions (5) of the weft yarn are biased by said elastic weft yarn (3) in a position that is lower than the plane of the warp yarns (2FS) corresponding to the under portions (4, 4') of the weft yarn (3), wherein the weave pattern of the weft yarns is identical for all the weft yarns of the said fabric, and wherein said fabric, after washing, has an elongation measured according to ASTM 3107, of at least 30%.

48. The fabric according to claim 2, wherein at least 80% of the weft yarns (3) are elastic.

* * * * *